US006925662B1

(12) United States Patent
Tan et al.

(10) Patent No.: US 6,925,662 B1
(45) Date of Patent: Aug. 9, 2005

(54) DIVERTER SPOUT

(75) Inventors: Wang-Hong Tan, Taichung (TW); Peng-Cheng Xia, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 19 days.

(21) Appl. No.: 10/926,026

(22) Filed: Aug. 26, 2004

(51) Int. Cl.[7] ..... E03C 1/04
(52) U.S. Cl. ..... 4/678; 137/801
(58) Field of Search ..... 4/567, 568, 675–678; 137/801; 239/282

(56) References Cited

U.S. PATENT DOCUMENTS 3,656,503 A * 4/1972 Ward ..... 137/359
3,746,031 A * 7/1973 Christiansen ..... 4/678
3,801,997 A * 4/1974 Ward ..... 4/668
3,906,983 A * 9/1975 Parkison ..... 137/467

* cited by examiner

*Primary Examiner*—Gregory L. Huson
*Assistant Examiner*—Huyen Le
(74) *Attorney, Agent, or Firm*—Troxell Law Office, PLLC

(57) ABSTRACT

A diverter spout has a drain pipe, a connecting sleeve, an offset shaft, a resilient element between the drain pipe and the offset shaft, a pole for manual operation, a supporting sleeve and an envelope. At least a leakproof rubber ring is mounted around the offset shaft. Due to interferential friction between the leakproof rings and the connecting sleeve or the supporting sleeve and water pressure, a blocking portion of the offset shaft controls the water to flow only through a spout. In normal state, the resilient element overcomes interferential friction between the leakproof rings and the connecting sleeve or the supporting sleeve and controls the water to flow only through a drain opening of the drainpipe. Therefore, water diverts reliably without leakage.

17 Claims, 5 Drawing Sheets

DIVERTER SPOUT

BACKGROUND OF THE INVENTION

1. Field of the Invention

The present invention relates to a diverter spout, and particularly to a diverter spout which is assembled with a spout and which reliably controls water so that water flows through only the diverter spout or only the spout and that water flows only through the diverter spout when water resource is shut off.

2. Related Art

As shown in FIG. 1, a conventional diverter spout, which is adapted to assemble with a spout, comprises a drain pipe 5, a control element 6, a pole 7 and a leakproof gasket 8. Further referring to FIG. 2, the drainpipe 5 defines a drain opening 50 and an assembling opening 51. A partition wall 52 is formed on the drainpipe 5 and defines a through hole 53 therein. A mounting hole 54 is defined in the drainpipe 5 for mounting the pole 7. The control element 6 includes an offset block 61 and a seal gasket 62. The offset block 61 defines a recess 610 in the vicinity of the through hole 53 for receiving the seal gasket 62. A clamp 611 extends from a side of the offset block 61 for retaining the pole 7. The pole 7 forms a neck 70 at an end thereof for corresponding to the clamp 611, and a manual portion 71 at an opposite end thereof for manual operation. Notably, along with the pole 7, the offset block 61 is movable up and down and leans on the partition wall 52.

Further combining with FIGS. 2 and 3. Normally, the offset block 61 is oriented at a lower portion of the partition wall 52; water may flow through the through hole 53 freely (in FIG. 2). The offset block 61 moves up when the pole 7 is pulled upwardly. Sequentially, the drainpipe 5 is filled with water and correspondingly produces water pressure to press the offset block 61 upwardly. The offset block 61 covers the through hole 53 (in FIG. 3), whereby water flows to the spout (not shown) instead of the drain opening 50 of the drain pipe 5.

The conventional diverter spout controls water so that water flows through the diverter spout or the spout. However, there are some deficiencies as below.

Firstly, the conventional diverter spout tends to leak. There is little friction between the offset block 61 and the partition wall 52. When the pole 7 is pulled up, the offset block 61 is retained to cover the through hole 53 entirely by water pressure in the drainpipe 5. However, the water pressure is unreliable. Moreover, there is collision force in water. The offset block 61 is apt to move downwardly. Thus the through hole 53 is covered incompletely, resulting in leakage of the drain opening 50. Even water flows to the drain opening 50 and the flout in turn or simultaneously.

Secondly, the conventional diverter spout requires rather precise manufacture. The cooperation between the offset block 61 and the partition wall 52 depends on orientation of assembling hole 54 and width of the offset block 61. If the precise requirement is not met, neither the through hole 53 is covered completely nor is the pole 7 pulled freely. Furthermore, flatness of the partition wall 52 may influence cooperation between the offset block 61 and the through hole 53. The partition wall 52 is formed at interior of the drainpipe 5, increasing difficulties in manufacture.

SUMMARY OF THE INVENTION

Accordingly, an object of the present invention is to provide a diverter spout, which reliably diverts water flow so that water controllably flows through only a drain opening or only a spout and effectively avoids leakage.

Another object of the present invention is to provide a diverter spout, which is manufactured easily.

The diverter spout comprises an offset shaft. The offset shaft forms a blocking portion at a lower portion thereof and a connecting portion at an upper portion thereof. The connecting portion defines a plurality of outlets around an outer peripheral thereof for communicating with a drain opening of a drainpipe. A first concave is defined around the offset shaft for receiving a leakproof ring. A gap is defined between the blocking portion and the drainpipe for allowing water to flow when the blocking portion aligns with a through hole of the drainpipe. A third concave is defined at an outer peripheral of a lower portion of the blocking portion for receiving a leakproof ring.

A resilient element is provided between the offset shaft and the drainpipe. The resilient element has such a spring coefficient that is larger than interferential friction between the leakproof rings and the drainpipe and that is smaller than a sum of interferential friction among the leakproof rings and the drainpipe and water pressure in the drainpipe.

In normal state, the connecting portion of the offset shaft is adjacent to the through hole owing to spring pressure of the resilient element. Meanwhile water flows only through the drain opening of the drainpipe. When the blocking portion moves to a position adjacent to the through hole, water is filled with the gap instead of the drain opening. Meanwhile water flows only through the spout. The friction force between the leakproof rings and the drainpipe and water pressure in the gap are large enough to overcome spring force of the resilient element and weight force of a pole. Thus the offset shaft is retained to a desired position. When water resource is shut off, water pressure in the drainpipe is released, spring force of the resilient element and weight force of the pole overcome the friction force between the leakproof rings and the drainpipe, consequently the offset shaft is pushed to a normal position.

DESCRIPTION OF THE PREFERRED EMBODIMENTS

Figure 1:
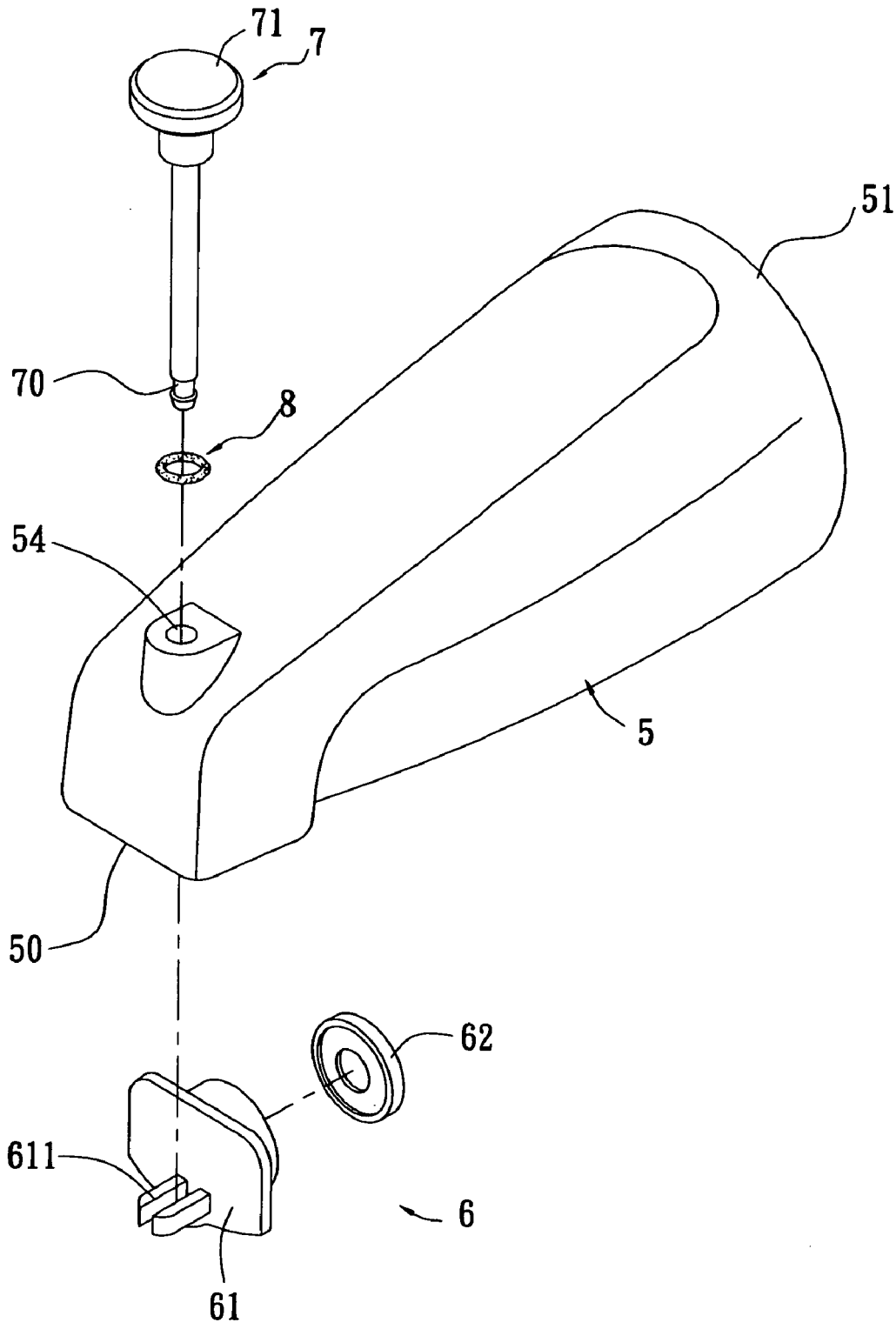
FIG. 1(Prior Art)
FIG. 1 is an exploded view of a conventional diverter spout.
Figure 2:
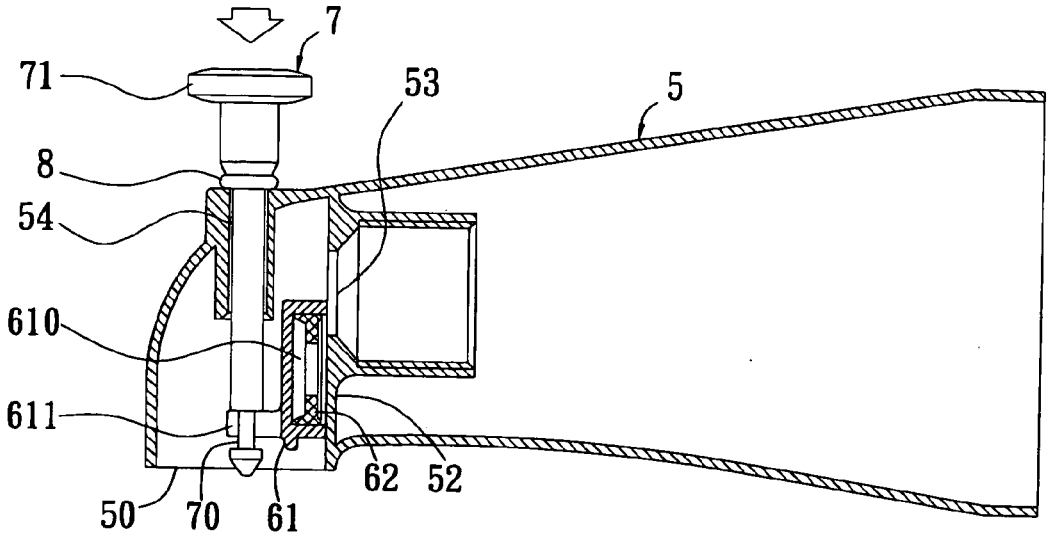
FIG. 2(Prior Art)
FIG. 2 is a cross-sectional view of the diverter spout of FIG. 1, wherein water flows through a drain opening of the diverter spout.
Figure 3:
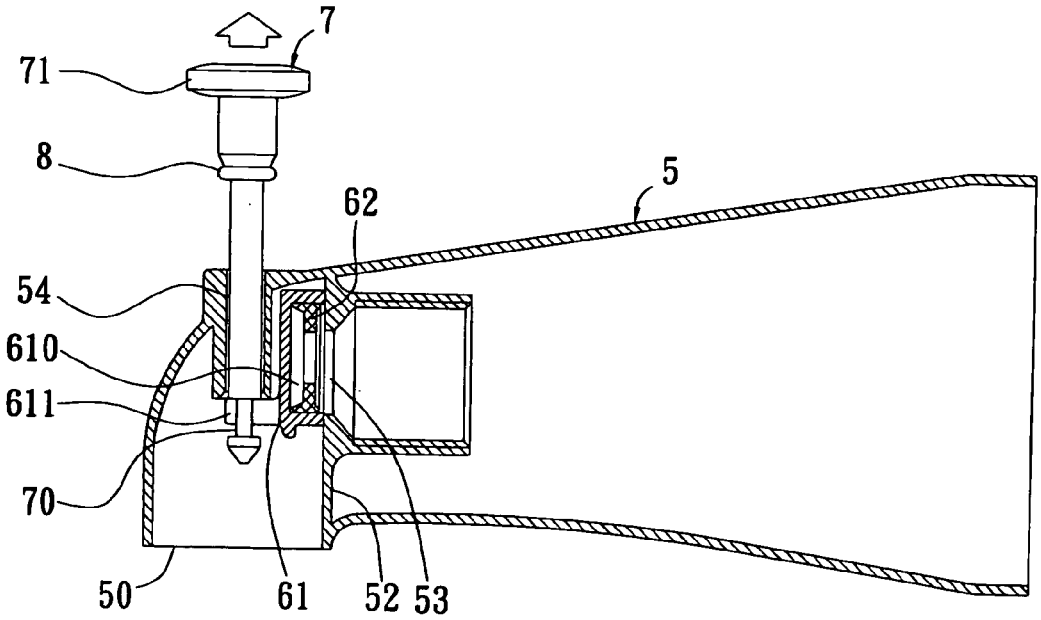
FIG. 3(Prior Art)
FIG. 3 is similar to FIG. 2, wherein water flows through a spout.
Figure 4:
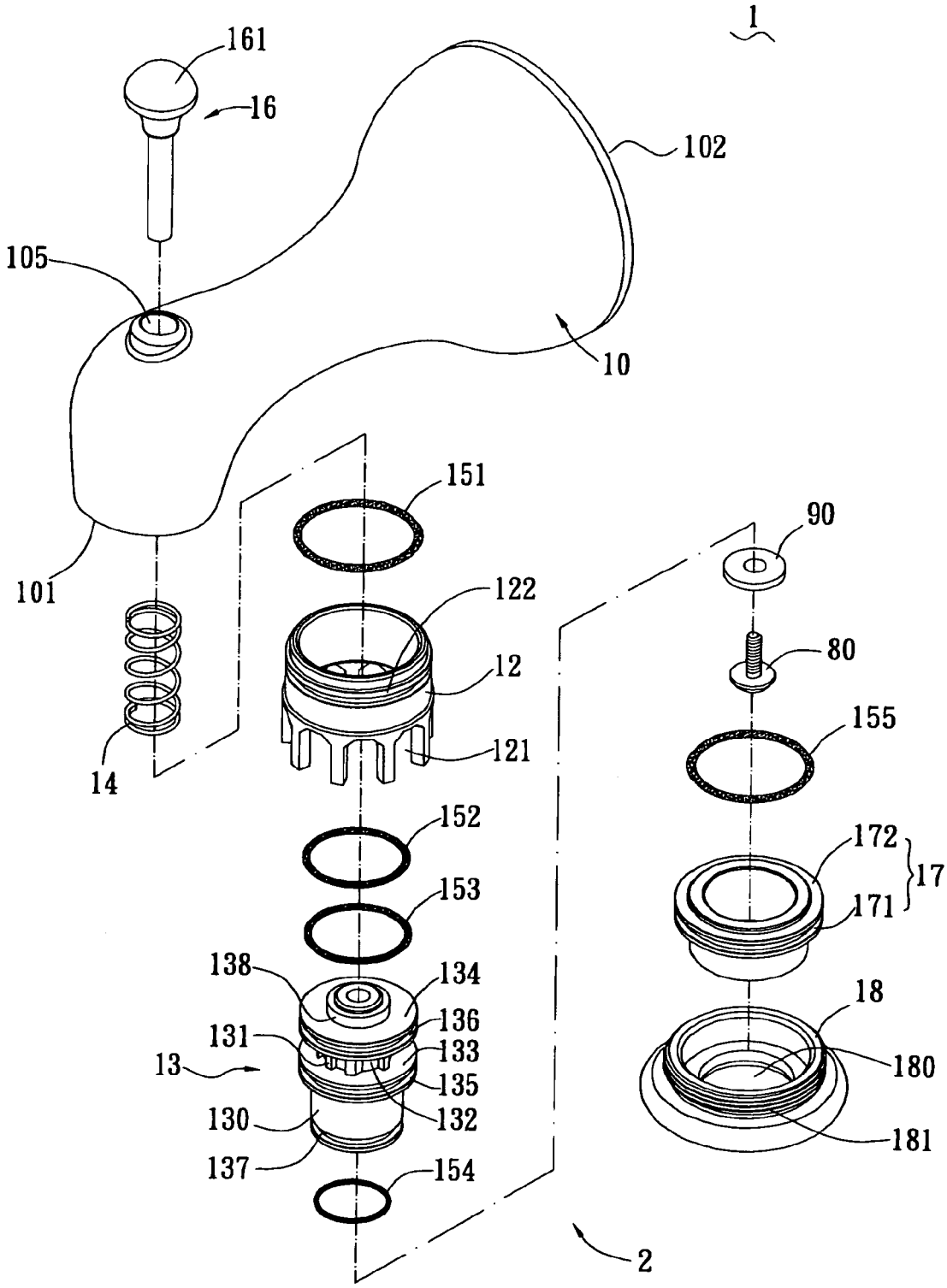
FIG. 4 is an exploded view of a diverter spout of the present invention.

With reference to FIG. 4, a diverter spout 1 of the present invention comprises a drain pipe 10, a connecting sleeve 12, an offset shaft 13, a resilient element 14, leakproof rings 151, 152, 153, 154, 155, a pole 16, a supporting sleeve 17 and an envelope 18. The drainpipe 10 defines a drain opening 101 for draining water and an assembling opening 102 for assembling to a water pipe. Further referring to FIG. 5, the drainpipe 10 forms an inner wall 103 between the drain opening 101 and the assembling opening 102. A through hole 104 is defined through a lower portion of the inner wall 103 for water flowing therethrough. A mounting hole 105 is defined in the drainpipe 10 and adjacent to the drain opening 101 for mounting the pole 16. A flute 106 is defined below the mounting hole 105 for abutting an end of the resilient element 14. In one embodiment, the resilient element 14 is a spring. The resilient element 14 has such spring coefficient that is larger than interferential friction between the leakproof rings 152, 153 and the connecting sleeve 17 and that is smaller than a sum of interferential friction between the leakproof rings 152, 153 and the connecting sleeve 17 and water pressure in the drainpipe 10.

The connecting sleeve 12 is assembled on the drain opening 101 and defines a plurality of inlets 121 at a lower portion thereof. A first groove 122 is defined around an outer peripheral of the connecting sleeve 12 and above the inlets 121 for accommodating the ring 151 therein and providing interferential friction between the connecting sleeve 12 and the drainpipe 10.

The offset shaft 13 is assembled on the connecting sleeve 12. The offset shaft 13 forms a blocking portion 130 at a lower portion thereof and a connecting portion 131 at an upper portion thereof. The connecting portion 131 is oriented adjacent to the through hole 104 in normal state. The connecting portion 131 defines a plurality of outlets 132 around an outer peripheral thereof for communicating with the drain opening 101. A first protrusion 133 is formed between the blocking portion 130 and the connecting portion 131 and defines a first concave 135 for receiving the ring 153. Notably, due to the first protrusion 133, a gap 139 is defined between the blocking portion 130 and the connecting sleeve 12 (referring to FIG. 6) for allowing water to flow when the blocking portion 130 aligns with the through hole 104. A third concave 137 is defined at an outer peripheral of a lower portion of the blocking portion 130 for receiving the ring 154. The connecting portion 131 forms a second protrusion 134 at an upper portion thereof and defines a second concave 136 around the second protrusion 134 for receiving the leakproof ring 152. The leakproof rings 152, 153 produce interferential friction with the connecting sleeve 12. The ring 154 produces interferential friction between the offset shaft 13 and the supporting sleeve 17. A flange 138 is formed at a top of the offset shaft 13 for abutting an end of the resilient element 14.

Figure 5:
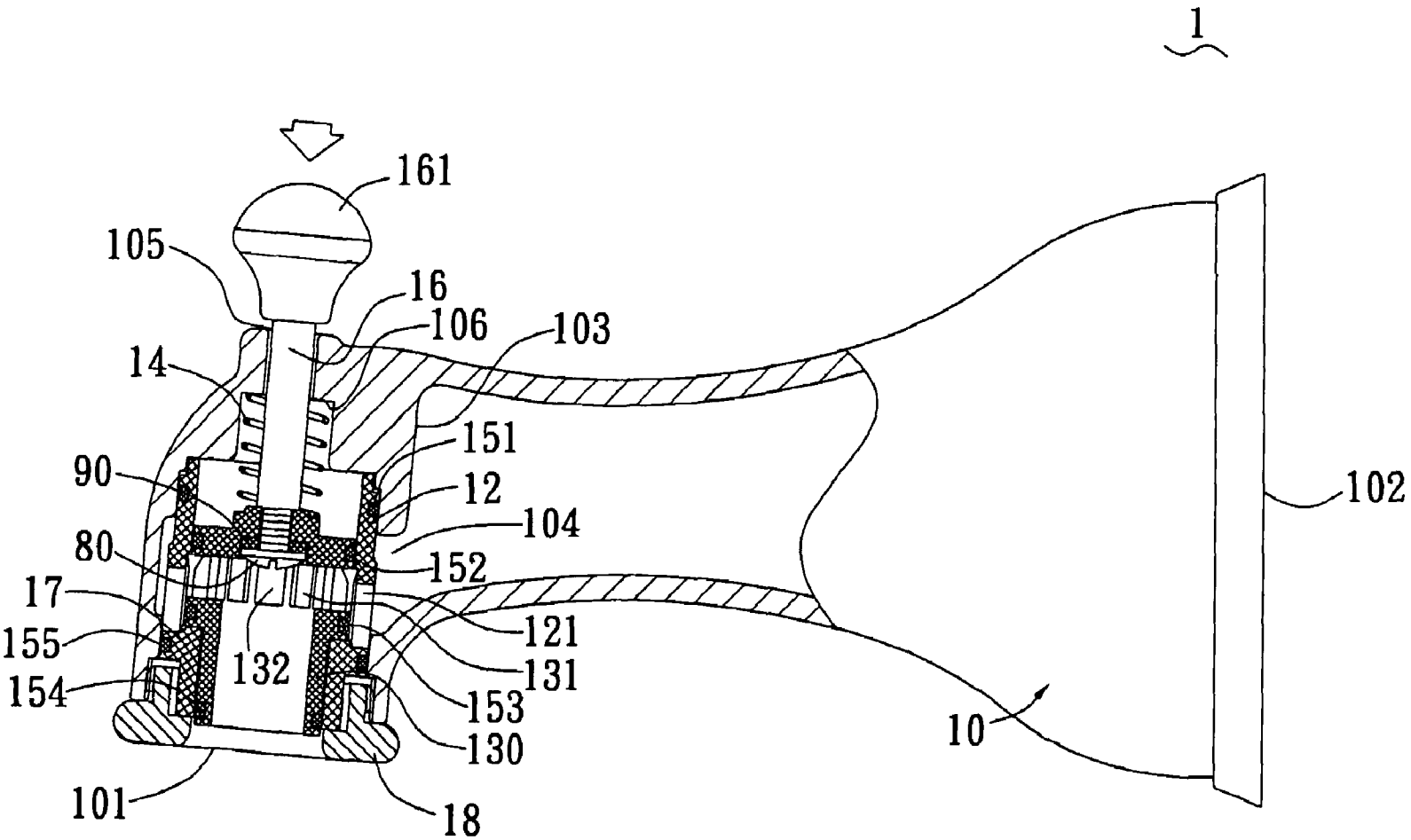
FIG. 5 is a cross-sectional view of the diverter spout of FIG. 4, wherein water flows through a drain opening of the diverter spout.

In combination with FIGS. 4 and 5, the pole 16 is assembled on the mounting hole 105. The pole 16 has a manual portion 161 at an upper end thereof and beyond the mounting hole 105, and a lower end connecting with the offset shaft 13. A screw 80 fixes the pole 16 on the offset shaft 13. A leakproof gasket 90 is mounted between the pole 16 and the screw 80. The resilient element 14 is mounted around the pole 16 and has an end abutting the offset shaft 13 and an opposite end abutting the drainpipe 10. The resilient element 14 has such spring coefficient that is larger than interferential friction between the leakproof rings 152, 153 and the connecting sleeve 12 and that is smaller than a sum of interferential friction between the leakproof rings 152, 153 and the connecting sleeve 12 and water pressure in the drainpipe 10.

The envelope 18 is fixed on the drain opening 101 and defines an axis hole 180 through a center thereof for corresponding to the drain opening 101. The envelope 18 further defines a spiral screw hole 181 for mounting on the drainpipe 10.

The supporting sleeve 17 is mounted on the envelope 18 and telescopically connects with the blocking portion 130 of the offset shaft 13. The supporting sleeve 17 forms a projection 170 at a middle portion thereof. A second groove 171 is defined around an outer peripheral of the projection 170 for receiving the ring 155 therein thereby providing interferential friction between the supporting sleeve 17 and the drain pipe 10. The supporting sleeve 17 has such a depth that the offset shaft 13 abuts against the supporting sleeve 17 when the connecting portion 131 moves to a position adjacent to the through hole 104 (shown in FIG. 5), and that the offset shaft 13 interferentially fits with the supporting sleeve 17 when the blocking portion 130 moves to a position adjacent to the through hole 104 (shown in FIG. 5). A shoulder 172 is formed on a top of the supporting sleeve 17 for positioning the supporting sleeve 17.

Figure 6:
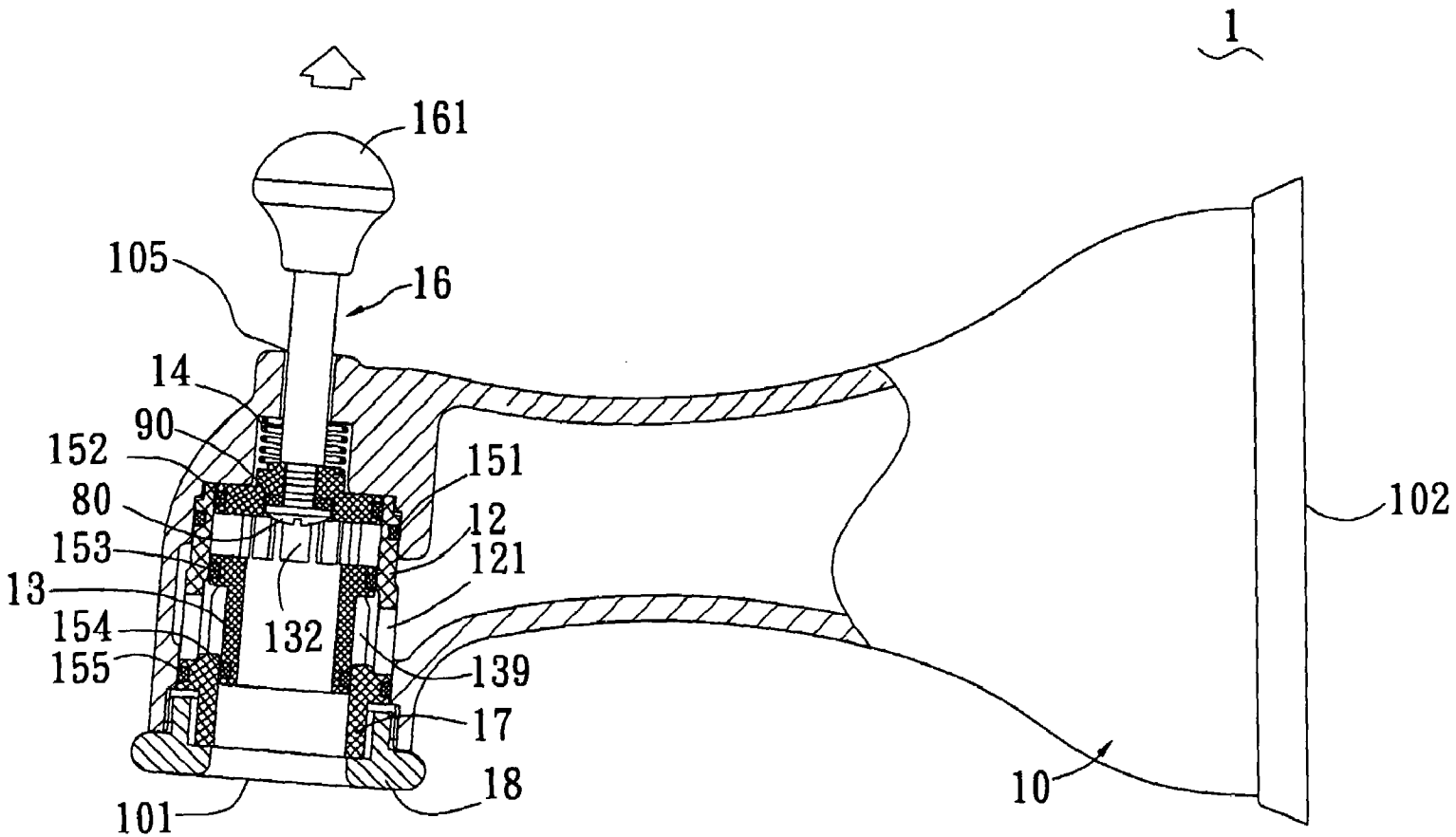
FIG. 6 is similar to FIG. 5, wherein water flows through a spout.

With combination of FIGS. 4, 5 and 6, in assembly, the leakproof rings 151, 152, 153, 154, 155 are respectively received in the first groove 122, the second concave 136, the first concave 135, the third concave 137 and the second groove 171. The resilient element 14, the connecting sleeve 12, the offset shaft 13, the supporting sleeve 17 and the envelope 18 are respectively mounted on the drainpipe 10 in turn. In normal state, referring to FIG. 5, the offset shaft 13 is oriented below the connecting sleeve 12 owing to spring pressure of the resilient element 14. The connecting portion 131 of the offset shaft 13 is adjacent to the through hole 104. Water flows through the through hole 104, the inlets 121, the outlets 132 and the drain opening 101 in sequence.

When the pole 16 is pulled up, water diverts to flow through a spout (not shown). Referring to FIG. 6, the offset shaft 13 is driven to move upwardly. The blocking portion 130 is adjacent to the through hole 104. Water is filled with the gap 139 instead of the drain opening 101. Meanwhile water flows only through the spout. The friction force between the leakproof rings 152, 153 and the connecting sleeve 12, the friction force between the ring 154 and the supporting sleeve 17, and water pressure in the gap 139 are large enough to overcome the spring force of the resilient element 14 and weight force of the pole 16. Thus the offset shaft 13 is retained to a desired position, correspondingly controlling water flow effectively.

When water resource is shut off, water pressure in the drain pipe 10 is released, the spring force of the resilient element 14 and weight force of the pole 16 overcome the friction force between the leakproof rings 152, 153 and the connecting sleeve 12 and the friction force between the ring 154 and the supporting sleeve 17, consequently the offset shaft 13 is pushed to a normal position.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A diverter spout, which is adapted to connect with a spout and controls water to flow through only the diverter spout or only the spout, comprising:

a drain pipe defining a drain opening and an assembling opening, an inner wall being formed between the drain opening and the assembling opening and defining a through hole and a mounting hole therein;

a connecting sleeve assembled on the drain opening and defining inlets corresponding to the through hole;

an offset shaft assembled on the connecting sleeve and including a connecting portion at an upper portion thereof and a blocking portion at a lower portion thereof, a first protrusion being formed between the blocking portion and the connecting portion and defining a gap between the blocking portion and the connecting sleeve, a first concave being defined in the first protrusion for receiving a leakproof ring, the connecting portion defining a plurality of outlets communicating with the drain opening, a third concave being defined at an outer peripheral of a lower portion of the blocking portion for receiving a leakproof ring;

a resilient element mounted between the offset shaft and the drain pipe, and having such a spring coefficient that is larger than interferential friction between the leakproof rings and the connecting sleeve and that is smaller than a sum of interferential friction among the leakproof rings and the connecting sleeve and water pressure in the drain pipe;

an envelope fixed on the drain opening, and defining an axis hole through a center thereof for corresponding to the drain opening;

a supporting sleeve mounted on the envelope and telescopically connecting with the blocking portion of the offset shaft; and a pole assembled on the assembling hole of the drainpipe, and having a manual portion at an upper end thereof, and a lower end connecting with the offset shaft.

2. The diverter spout as claimed in claim 1, wherein the resilient element is a spring, and wherein the resilient element is mounted around the pole, and has an end abutting the offset shaft and an opposite end abutting the drainpipe.

3. The diverter spout as claimed in claim 2, wherein a flute is defined below the mounting hole for abutting an end of the resilient element, and wherein a flange is formed at a top of the offset shaft for abutting an opposite end of the resilient element.

4. The diverter spout as claimed in claim 1, wherein the connecting portion forms a second protrusion at an upper portion thereof, and a second concave is defined around the second protrusion for receiving a leakproof ring thereby producing interferential friction between the connection portion and the connecting sleeve.

5. The diverter spout as claimed in claim 4, wherein the leakproof rings in the first concave, the third concave and the second concave are made of rubber.

6. The diverter spout as claimed in claim 1, wherein a first groove is defined around an outer peripheral of the connecting sleeve for accommodating a leakproof ring therein thereby providing interferential friction between the connecting sleeve and the drainpipe.

7. The diverter spout as claimed in claim 1, wherein the supporting sleeve has such a depth that the offset shaft abuts against the supporting sleeve when the connecting portion moves to a position adjacent to the through hole, and that the offset shaft interferentially fits with the supporting sleeve when the blocking portion moves to a position adjacent to the through hole.

8. The diverter spout as claimed in claim 1, wherein a projection is formed at a middle portion of the supporting sleeve and defines a second groove around an outer peripheral thereof for receiving a leakproof ring therein, thereby providing interferential friction between the supporting sleeve and the drain pipe.

9. The diverter spout as claimed in claim 1, wherein a shoulder is formed on a top of the supporting sleeve for positioning the supporting sleeve.

10. The diverter spout as claimed in claim 9, wherein a leakproof gasket is mounted between the pole and the screw.

11. The diverter spout as claimed in claim 1, wherein a screw fixes the pole on the offset shaft.

12. The diverter spout as claimed in claim 1, wherein the envelope further defines a spiral screw hole for mounting on the drainpipe.

13. The diverter spout as claimed in claim 12, wherein the resilient element is a spring, and wherein the resilient element is mounted around the pole and has an end abutting the offset shaft and an opposite end abutting the drainpipe.

14. The diverter spout as claimed in claim 12, wherein the connecting portion forms a second protrusion at an upper portion thereof, and a second concave is defined around the second protrusion for receiving a rubber ring thereby producing interferential friction between the connection portion and the connecting sleeve.

15. The diverter spout as claimed in claim 12, wherein the leakproof rings in the first concave, the third concave and the second concave are made of rubber.

16. A diverter spout, which is adapted to connect with a spout and controls water to flow through only the diverter spout or only the spout, comprising:

a drain pipe defining a drain opening and an assembling opening, an inner wall being formed between the drain opening and the assembling opening and defining a through hole and a mounting hole therein;

an offset shaft assembled on the drain opening and including a connecting portion at an upper portion thereof and a blocking portion at a lower portion thereof, a first protrusion being formed between the blocking portion and the connecting portion and defining a gap between the blocking portion and the inner wall of the drain pipe, a first concave being defined in the first protrusion for receiving a ring, the connecting portion defining a plurality of outlets communicating with the drain opening, a third concave being defined at an outer peripheral of a lower portion of the blocking portion for receiving a ring;

a resilient element mounted between the offset shaft and the drain pipe, and having such a spring coefficient that is larger than interferential friction between the leakproof rings and the connecting sleeve and that is smaller than a sum of interferential friction between the leakproof rings and the connecting sleeve and water pressure in the drain pipe;

an envelope fixed on the drain opening, and defining an axis hole through a center thereof for corresponding to the drain opening; and a pole assembled on the assembling hole of the drainpipe, and having a manual portion at an upper end thereof, and a lower end connecting with the offset shaft.

17. The diverter spout as claimed in claim 16, wherein a flute is defined in the drainpipe for abutting an end of the resilient element, and wherein a flange is formed at a top of the offset shaft for abutting an opposite end of the resilient element.

* * * * *